US008622768B2

(12) United States Patent
Van Swearingen et al.

(10) Patent No.: US 8,622,768 B2
(45) Date of Patent: Jan. 7, 2014

(54) CONNECTOR WITH CAPACITIVELY COUPLED CONNECTOR INTERFACE

(71) Applicant: Andrew LLC, Hickory, NC (US)

(72) Inventors: Kendrick Van Swearingen, Woodridge, IL (US); Ronald Alan Vaccaro, Shorewood, IL (US); James P Flemming, Orland Park, IL (US); Jeffrey D Paynter, Memence, IL (US)

(73) Assignee: Andrew LLC, Hickory, NC (US)

( * ) Notice: Subject to any disclaimer, the term of this patent is extended or adjusted under 35 U.S.C. 154(b) by 0 days.

(21) Appl. No.: 13/673,084

(22) Filed: Nov. 9, 2012

(65) Prior Publication Data

US 2013/0065420 A1 Mar. 14, 2013

Related U.S. Application Data

(63) Continuation-in-part of application No. 13/571,073, filed on Aug. 9, 2012, and a continuation-in-part of application No. 13/427,313, filed on Mar. 22, 2012, and a continuation-in-part of application No. 13/294,586, filed on Nov. 11, 2011, said application No. 13/571,073 is a continuation-in-part of application No. 13/240,344, filed on Sep. 22, 2011, and a continuation-in-part of application No. 13/208,443, filed on Aug. 12, 2011, said application No. 13/240,344 is a continuation-in-part of application No. 13/170,958, filed on Jun. 28, 2011, and a continuation-in-part of application No. 13/161,326, filed on Jun. 15, 2011, now Pat. No. 8,365,404, and a continuation-in-part of application No. 12/980,013, filed on Dec. 28, 2010, now Pat. No. 8,453,320, and a continuation-in-part of application No. 12/974,765, filed on Dec. 21, 2010, and a continuation-in-part of application No. 12/962,943, filed on Dec. 8, 2010, now Pat. No. 8,302,296, and a continuation-in-part of application No. 12/951,558, filed on Nov. 22, 2010, application No. 13/673,084, which is a continuation-in-part of application No. 13/644,081, filed on Oct. 3, 2012, now Pat. No. 8,479,383.

(51) Int. Cl.
*H01R 9/05* (2006.01)

(52) U.S. Cl.
USPC ..... 439/578; 439/315

(58) Field of Classification Search
USPC ..... 439/578, 315, 316, 317, 313, 312
See application file for complete search history.

(56) References Cited

U.S. PATENT DOCUMENTS 2,516,529 A 7/1950 Raymond
2,847,499 A 8/1958 Peterson (Continued)

OTHER PUBLICATIONS

So Yeon Jeong, International Search Report of Counterpart International Application No. PCT/US12/64572, Mar. 28, 2013, Daejeon Metropolitan City, Korea.

*Primary Examiner* — Hae Hyeon
(74) *Attorney, Agent, or Firm* — Babcock IP, PLLC

(57) ABSTRACT

A connector with a capacitively coupled connector interface for interconnection with a female portion is provided with an annular groove, with a sidewall, open to an interface end of the female portion. A male portion is provided with a male outer conductor coupling surface at an interface end, covered by an outer conductor dielectric spacer. The male outer conductor coupling surface is dimensioned to seat, spaced apart from the sidewall by the outer conductor dielectric spacer, within the annular groove, when the male portion and the female portion are in an interlocked position, secured by a releasable retainer dimensioned to secure the male portion and the female portion in the interlocked position.

20 Claims, 17 Drawing Sheets

(56) References Cited

U.S. PATENT DOCUMENTS

| | | | | |
|---|---|---|---|---|
| 2,994,050 | A | 7/1961 | Ayer et al. | |
| 3,089,105 | A | 5/1963 | Alford | |
| 3,258,724 | A | 6/1966 | Walsh et al. | |
| 3,586,757 | A | 6/1971 | Haldeman, Jr. | |
| 3,617,607 | A | 11/1971 | Williams | |
| 3,970,969 | A | 7/1976 | Sirel et al. | |
| 3,980,976 | A | 9/1976 | Tadama et al. | |
| 4,038,625 | A | 7/1977 | Tompkins et al. | |
| 4,399,419 | A | 8/1983 | Dobrovolny | |
| 4,586,008 | A | 4/1986 | Raleigh | |
| 4,884,982 | A | 12/1989 | Fleming et al. | |
| 5,073,761 | A | 12/1991 | Waterman et al. | |
| 5,276,415 | A | 1/1994 | Lewandowski et al. | |
| 5,327,111 | A | 7/1994 | Gipprich | |
| 5,471,222 | A | 11/1995 | Du | |
| 5,557,290 | A | 9/1996 | Watanabe | |
| 5,659,889 | A | 8/1997 | Cockson | |
| 5,796,315 | A | 8/1998 | Gordon et al. | |
| 5,977,841 | A | 11/1999 | Lee et al. | |
| 6,414,636 | B1 | 7/2002 | Godard et al. | |
| 6,496,353 | B1 | 12/2002 | Chio | |
| 6,525,620 | B1 | 2/2003 | Barabash | |
| 6,683,254 | B1 | 1/2004 | Gunnels | |
| 6,798,310 | B2 | 9/2004 | Wong et al. | |
| 6,853,337 | B2 | 2/2005 | Barabash | |
| 6,926,555 | B2 | 8/2005 | Nelson | |
| 7,094,104 | B1 | 8/2006 | Burke et al. | |
| 7,385,457 | B2 | 6/2008 | Cordes et al. | |
| 7,607,942 | B1 | 10/2009 | Van Swearingen | |
| 7,869,974 | B2 | 1/2011 | Plishner | |
| 8,174,132 | B2 | 5/2012 | Van Swearingen | |
| 8,460,031 | B2 * | 6/2013 | Paynter et al. | 439/584 |
| 2006/0172571 | A1 | 8/2006 | Montena | |
| 2008/0170346 | A1 | 7/2008 | Van Swearingen | |
| 2013/0065415 | A1 * | 3/2013 | Van Swearingen et al. | 439/247 |
| 2013/0065422 | A1 * | 3/2013 | Van Swearingen et al. | 439/378 |

* cited by examiner

CONNECTOR WITH CAPACITIVELY COUPLED CONNECTOR INTERFACE

BACKGROUND

1. Field of the Invention

This invention relates to electrical cable connectors. More particularly, the invention relates to connectors with an interconnection interface with capacitive coupling between signal conducting portions of the connection interface.

2. Description of Related Art

Coaxial cables are commonly utilized in RF communications systems. Coaxial cable connectors may be applied to terminate coaxial cables, for example, in communication systems requiring a high level of precision and reliability.

Connector interfaces provide a connect and disconnect functionality between a cable terminated with a connector bearing the desired connector interface and a corresponding connector with a mating connector interface mounted on an apparatus or a further cable. Prior coaxial connector interfaces typically utilize a retainer provided as a threaded coupling nut which draws the connector interface pair into secure electro-mechanical engagement as the coupling nut, rotatably retained upon one connector, is threaded upon the other connector.

Passive Intermodulation Distortion (PIM) is a form of electrical interference/signal transmission degradation that may occur with less than symmetrical interconnections and/or as electro-mechanical interconnections shift or degrade over time, for example due to mechanical stress, vibration, thermal cycling, and/or material degradation. PIM is an important interconnection quality characteristic as PIM generated by a single low quality interconnection may degrade the electrical performance of an entire RF system.

Recent developments in RF coaxial connector design have focused upon reducing PIM by improving interconnections between the conductors of coaxial cables and the connector body and/or inner contact, for example by applying a molecular bond instead of an electro-mechanical interconnection, as disclosed in commonly owned US Patent Application Publication 2012/0129391, titled "Connector and Coaxial Cable with Molecular Bond Interconnection", by Kendrick Van Swearingen and James P. Fleming, published on 24 May 2012 and hereby incorporated by reference in its entirety.

Competition in the cable connector market has focused attention on improving interconnection performance and long term reliability of the interconnection. Further, reduction of overall costs, including materials, training and installation costs, is a significant factor for commercial success.

Therefore, it is an object of the invention to provide a coaxial connector and method of interconnection that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventor has recognized that PIM may be generated at, in addition to the interconnections between the inner and outer conductors of a coaxial cable and each coaxial connector, the electrical interconnections between the connector interfaces of mating coaxial connectors.

Figure 1:
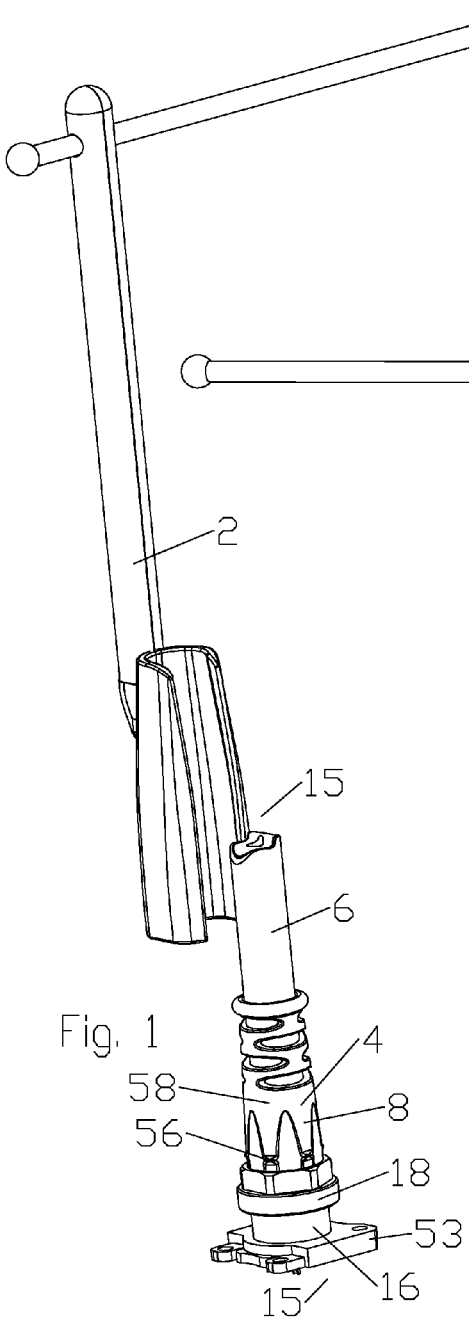
FIG. 1 is a schematic angled isometric view of an exemplary embodiment of a connector with a tabbed interconnection interface, showing a male portion coupled to a female portion, with a basin wrench.
Figure 2:
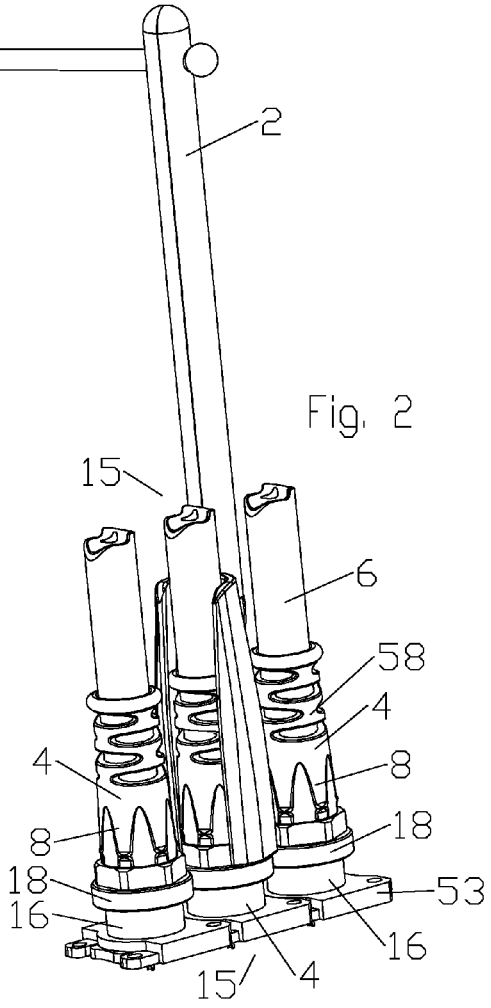
FIG. 2 is a schematic angled isometric view of the interconnection of FIG. 1, demonstrated with the connector in close proximity to adjacent connectors, with the basin wrench attached for rotation of the lock.

Further, threaded interconnection interfaces may be difficult to connect in high density/close proximity connector situations as a basin-type wrench 2 is required to access the connector 4, the wrench handle spaced away from the connector 4 along the longitudinal axis of the connector 4, for example as shown in FIGS. 1 and 2. Although it is possible to thread the connector bodies/coupling nuts together, starting the threading may be difficult as the access to control how the connector bodies are aligning/seating together is frustrated and the repeated rotation required during the threading typically interferes with the cable 6 extending from the connector 4 and/or the cables 6 of adjacent connectors 4. Even where smaller diameter cables 6 are utilized, standard quick connection interfaces such as BNC-type interconnections may provide unsatisfactory electrical performance with respect to PIM, as the connector body may pivot laterally along the opposed dual retaining pins and internal spring element, due to the spring contact applied between the male and female portions, according to the BNC interface specification.

An exemplary embodiment of a tabbed connector interface, as shown in FIGS. 1-17, demonstrates a rigid connector interface where the male and female portions 8, 16 seat together interlocked by sets of symmetrically meshed and interlocking tabs, demonstrated in the present embodiment as sets of three tabs each.

Figure 3:
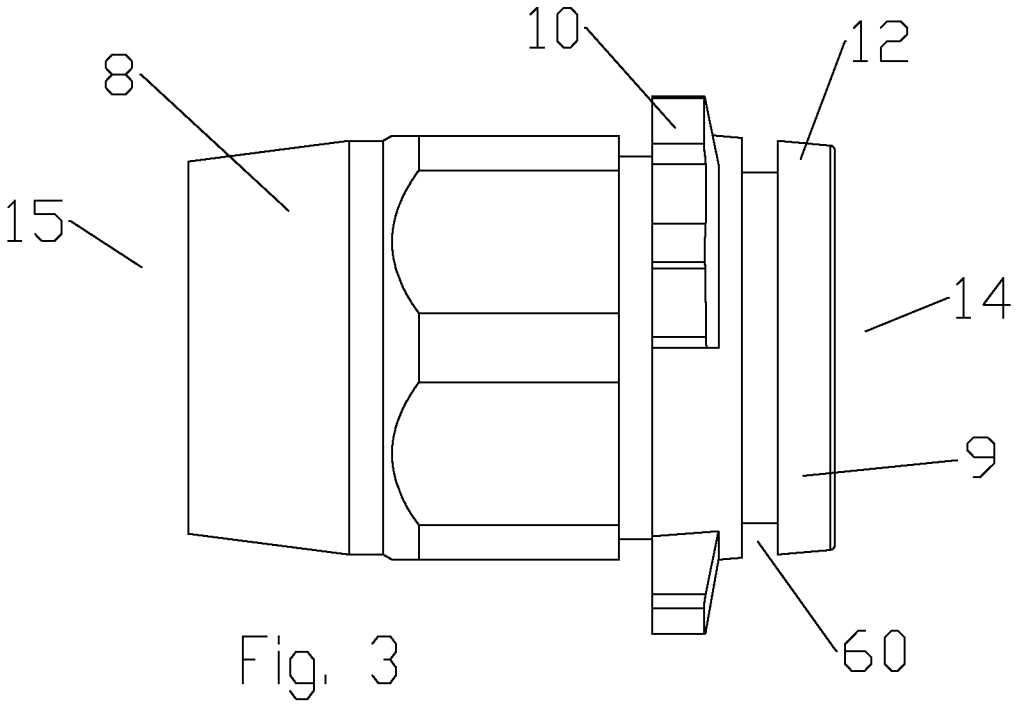
FIG. 3 is a schematic side view of an exemplary male portion of the interconnection of FIG. 1.
Figure 4:
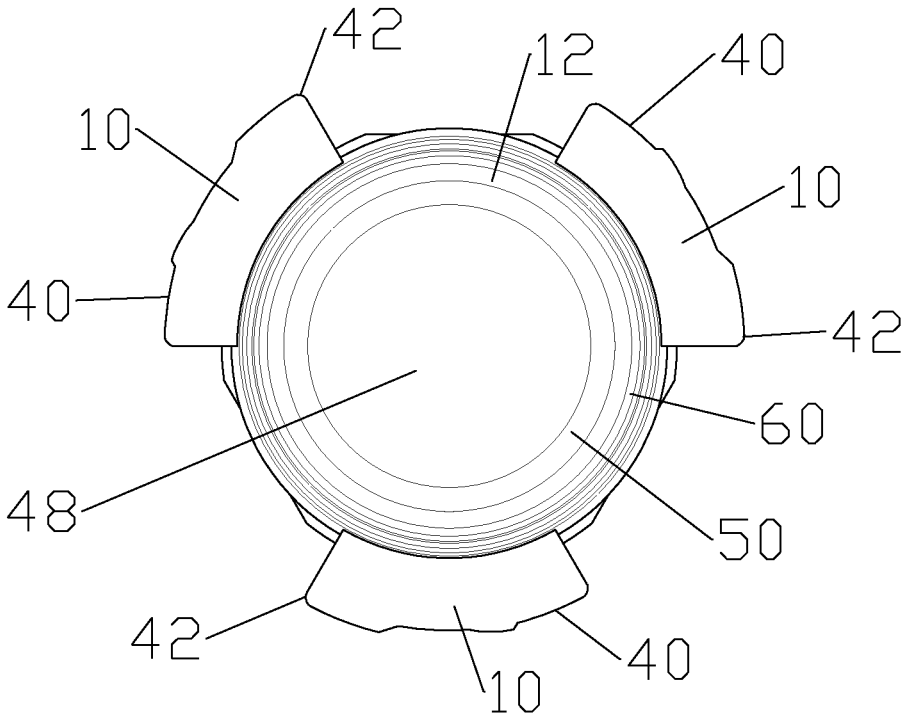
FIG. 4 is a schematic interface end view of the male portion of FIG. 3.

As best shown in FIGS. 3 and 4, a male portion 8 has, for example, three outer diameter radial projecting connector tabs 10 and a male outer conductor coupling surface 9 provided as a conical outer diameter seat surface 12 at an interface end 14.

Figure 5:
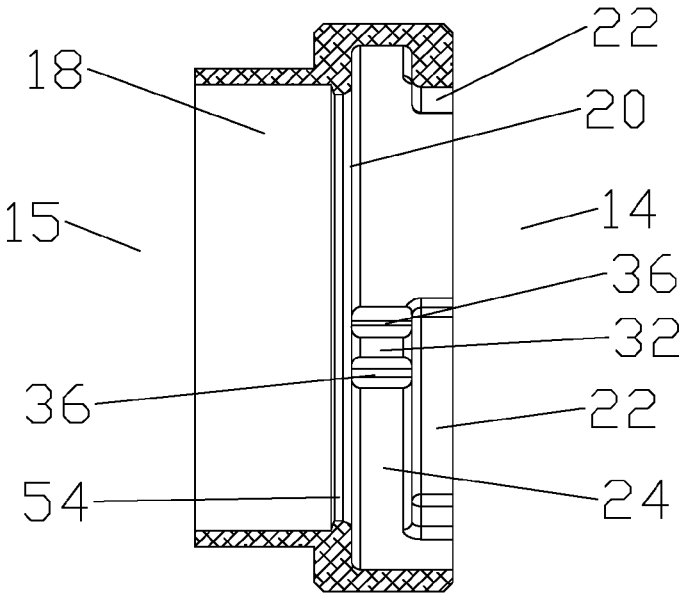
FIG. 5 is a schematic cut-away side view of the releasable retainer of FIG. 6.
Figure 6:
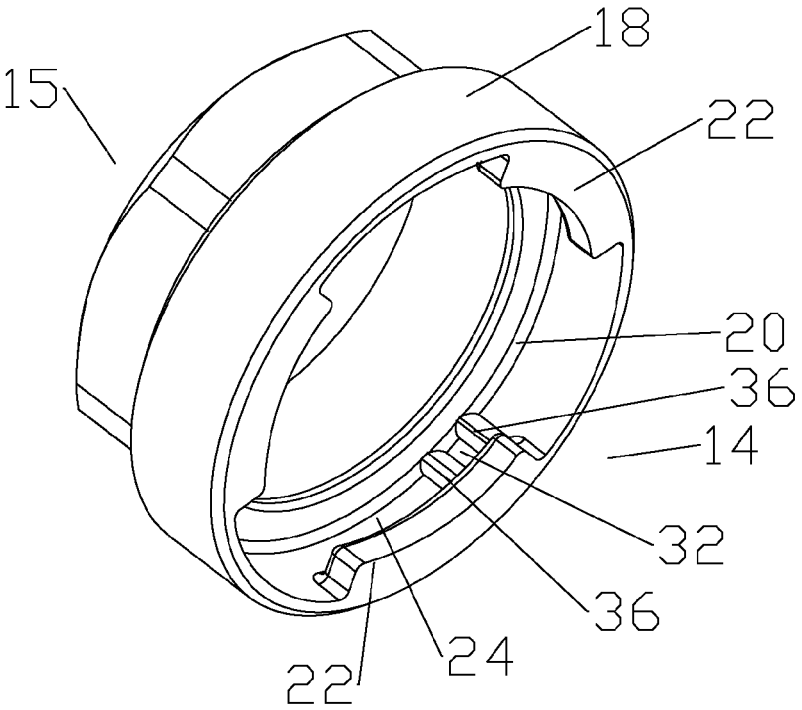
FIG. 6 is a schematic isometric view of an exemplary releasable retainer of the interconnection of FIG. 1.
Figure 7:
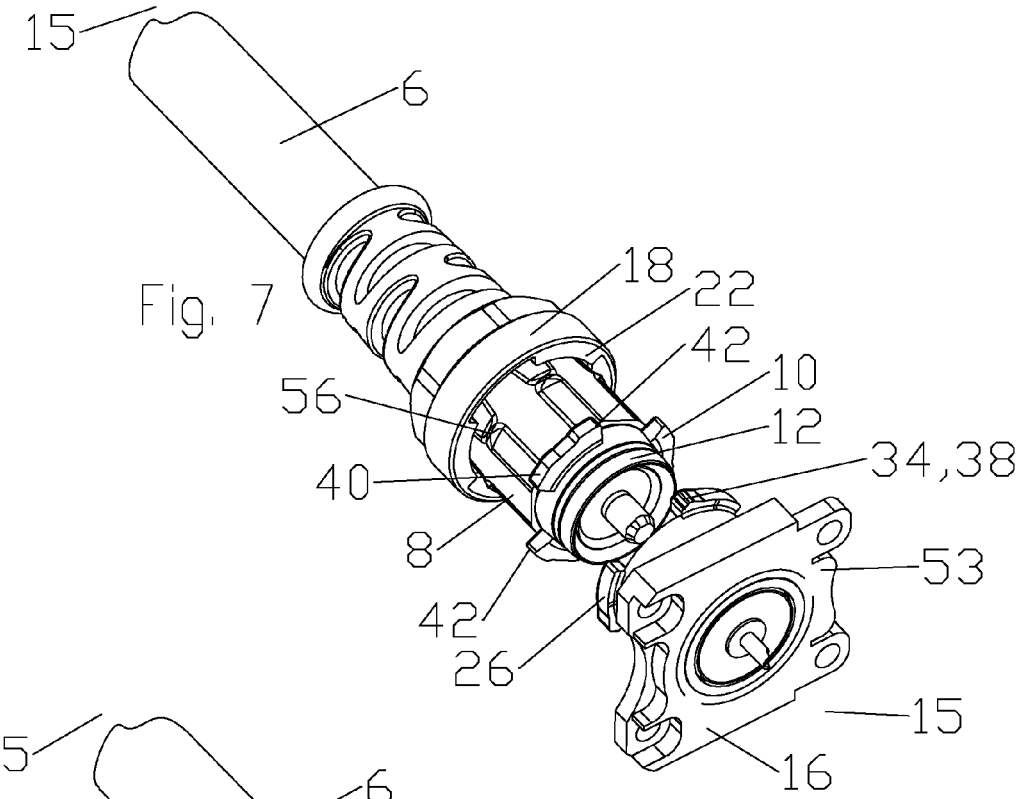
FIG. 7 is a schematic isometric view of the interconnection of FIG. 1, prior to male portion to female portion interconnection, with the releasable retainer advanced towards the cable end.
Figure 8:
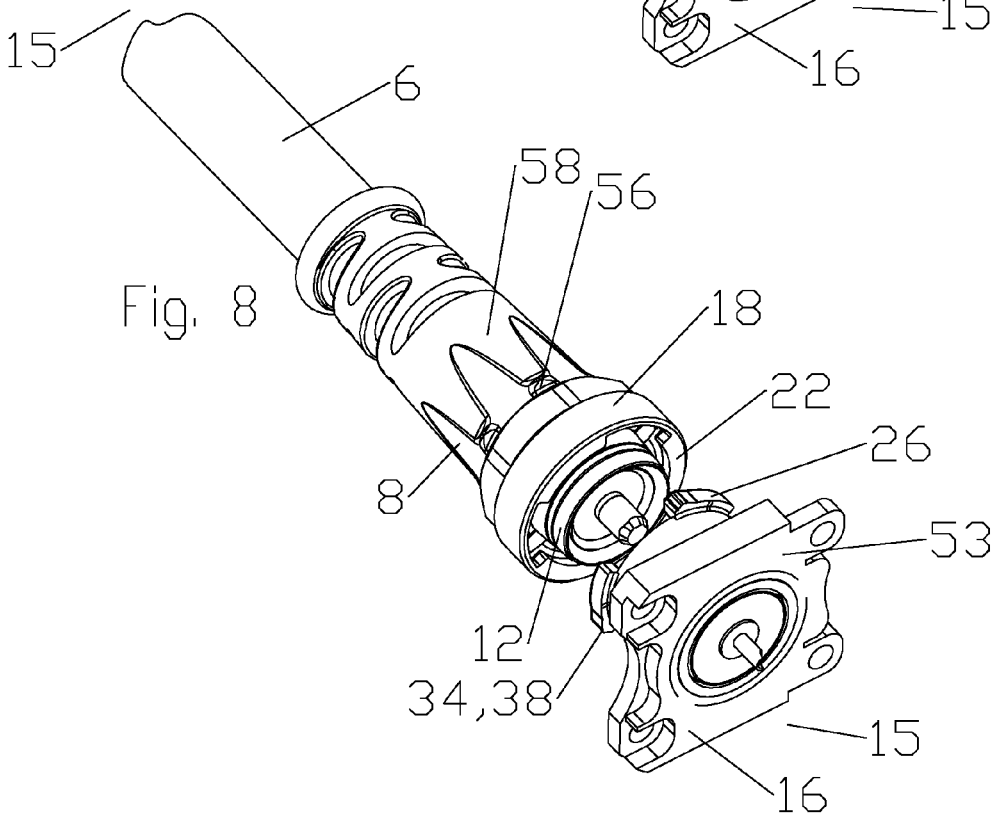
FIG. 8 is a schematic isometric view of FIG. 7, with the releasable retainer seated against the connector tabs and rotated so the coupling tabs are aligned with the connector tabs for initial insertion of the male portion into the female portion.
Figure 9:
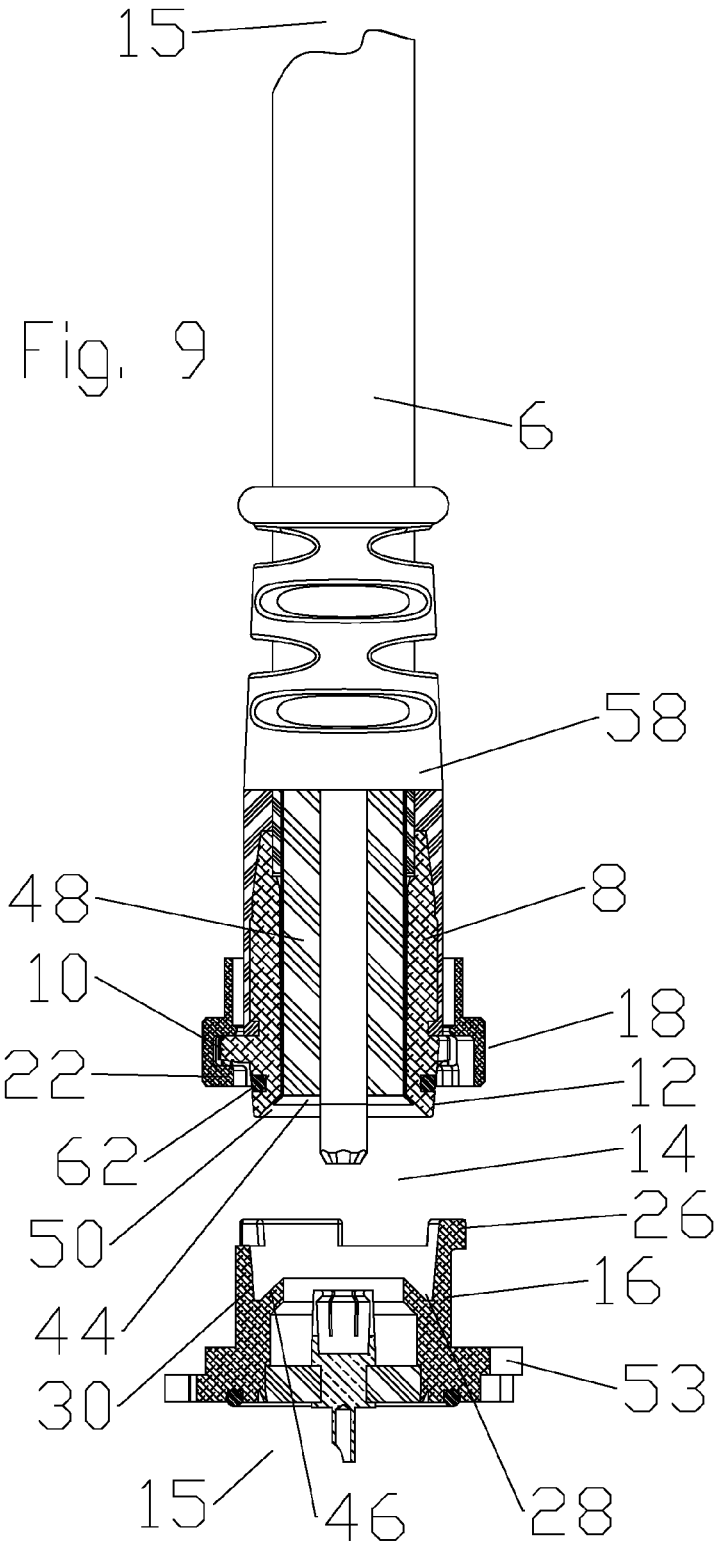
FIG. 9 is a schematic partial cut-away side view of FIG. 8.

One skilled in the art will appreciate that interface end 14 and cable end 15 are applied herein as identifiers for respective ends of both the connector and also of discrete elements of the connector described herein, to identify same and their respective interconnecting surfaces according to their alignment along a longitudinal axis of the connector between an interface end 14 and a cable end 15 of each of the male and female portions 8, 16. When interconnected by the connector interface, the interface end 14 of the male portion 8 is coupled to the interface end 14 of the female portion 16. As shown in FIGS. 5 and 6, a releasable retainer 18 is provided with a stop shoulder 20 and radially inward coupling tabs 22 proximate the interface end 14. The number of coupling tabs 22 corresponds to the number of connector tabs 10 applied to the male portion 8. The releasable retainer 18 is dimensioned to seat around the male portion 8, the stop shoulder 20 abutting the cable end 15 of the connector tabs 10. A tab seat 24 is provided between the coupling tabs 22 and the stop shoulder 20. As shown in FIG. 7, the releasable retainer 18 may be seated by aligning the coupling tabs 22 with spaces between each of the connector tabs 10 so that the coupling tabs 22 extend below the connector tabs 10 when the stop shoulder 20 is seated against the cable end 15 of the connector tabs 10. As shown in FIGS. 8 and 9, the releasable retainer 18 may then be rotated so that the coupling tabs 22 are in a shadow of the connector tabs 10, ready for insertion of the male portion 8 into the female portion 16.

Figure 10:
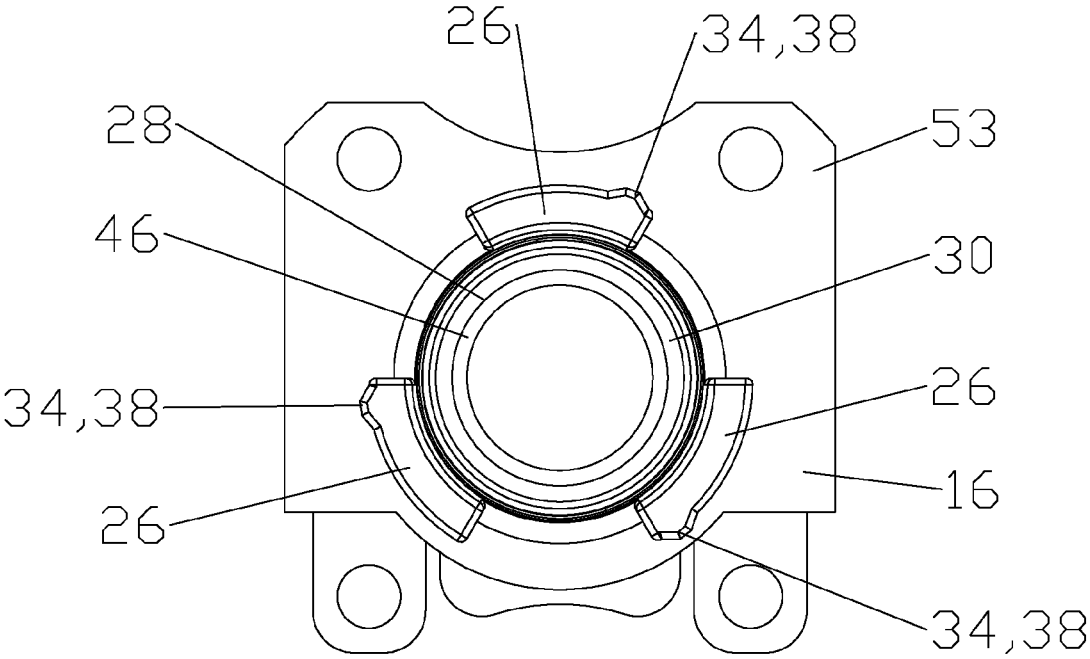
FIG. 10 is a schematic interface end view of the female portion of the interconnection.
Figure 11:
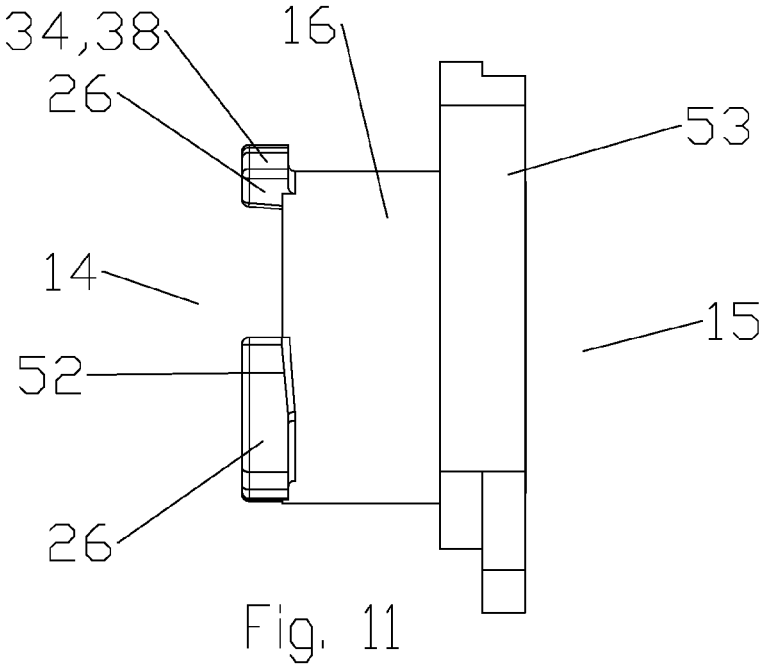
FIG. 11 is a schematic side view of the female portion of FIG. 10.

As shown in FIGS. 10 and 11, the female portion 16 is provided with a plurality of radially projecting base tabs 26, corresponding to the number of connector tabs 10, and an annular groove 28 open to the interface end 14.

Figure 12:
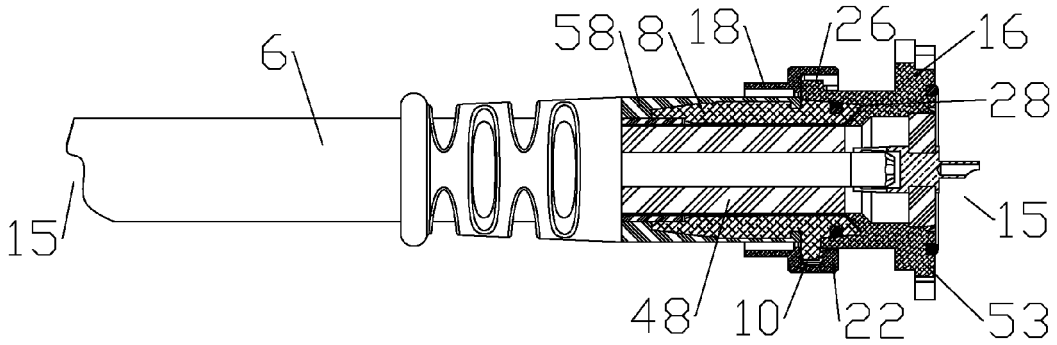
FIG. 12 is a schematic partial cut-away side view of the interconnection of FIG. 1, the male portion seated within the female portion, prior to rotation of the releasable retainer.
Figure 13:
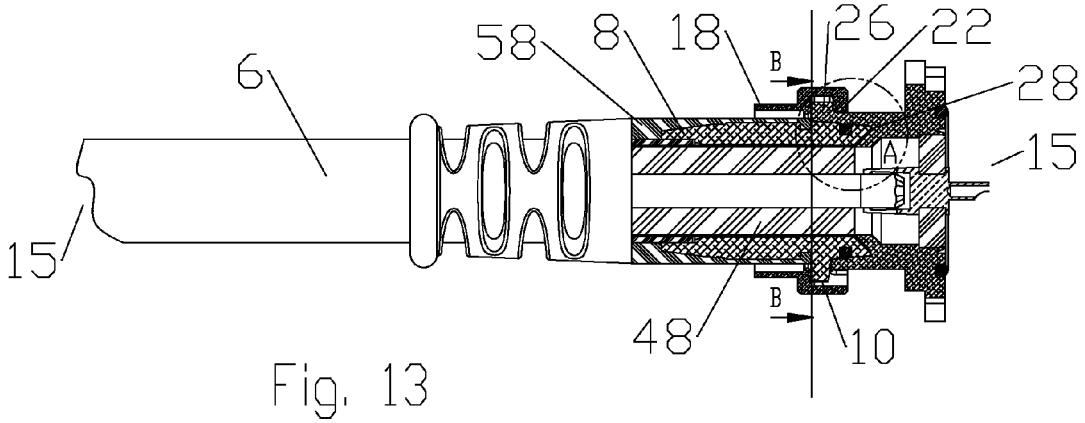
FIG. 13 is a schematic partial cut-away side view of FIG. 12, with the releasable retainer rotated sixty degrees to complete the interconnection.
Figure 14:
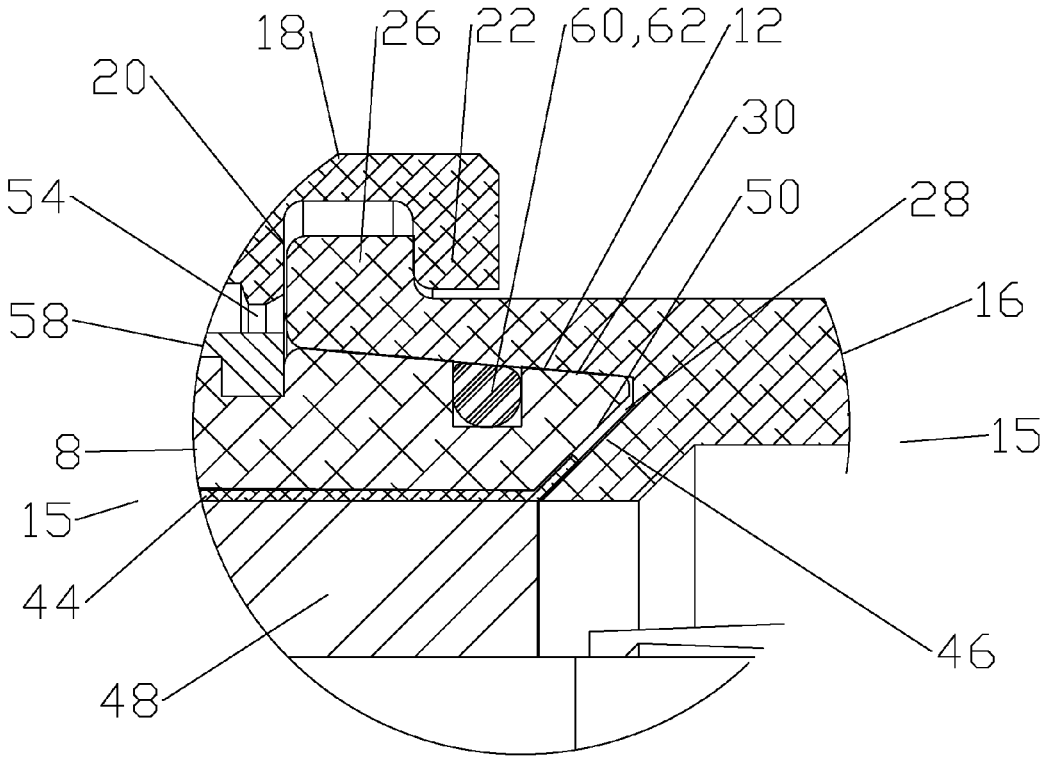
FIG. 14 is a close-up view of area A of FIG. 13.

FIGS. 12-14 demonstrate engagement details as the male portion 8 is seated within the female portion 16 and the releasable retainer 18 rotated to secure the interconnection. As best shown in FIG. 14, an outer sidewall 30 of the annular groove 28 is dimensioned to mate with the male outer conductor coupling surface 9, here provided as a conical outer diameter seat surface 12 enabling self-aligning conical surface to conical surface mutual seating between the male and female portions 8, 16.

The base tabs 26 are dimensioned to engage the coupling tabs 22 when the base tabs 26 are inserted into the tab seat 24 as the releasable retainer 18 is rotated, retaining the outer diameter seat surface 12 against the outer sidewall 30 to form a rigid interconnection of the male and female portions 8, 16.

Figure 15:
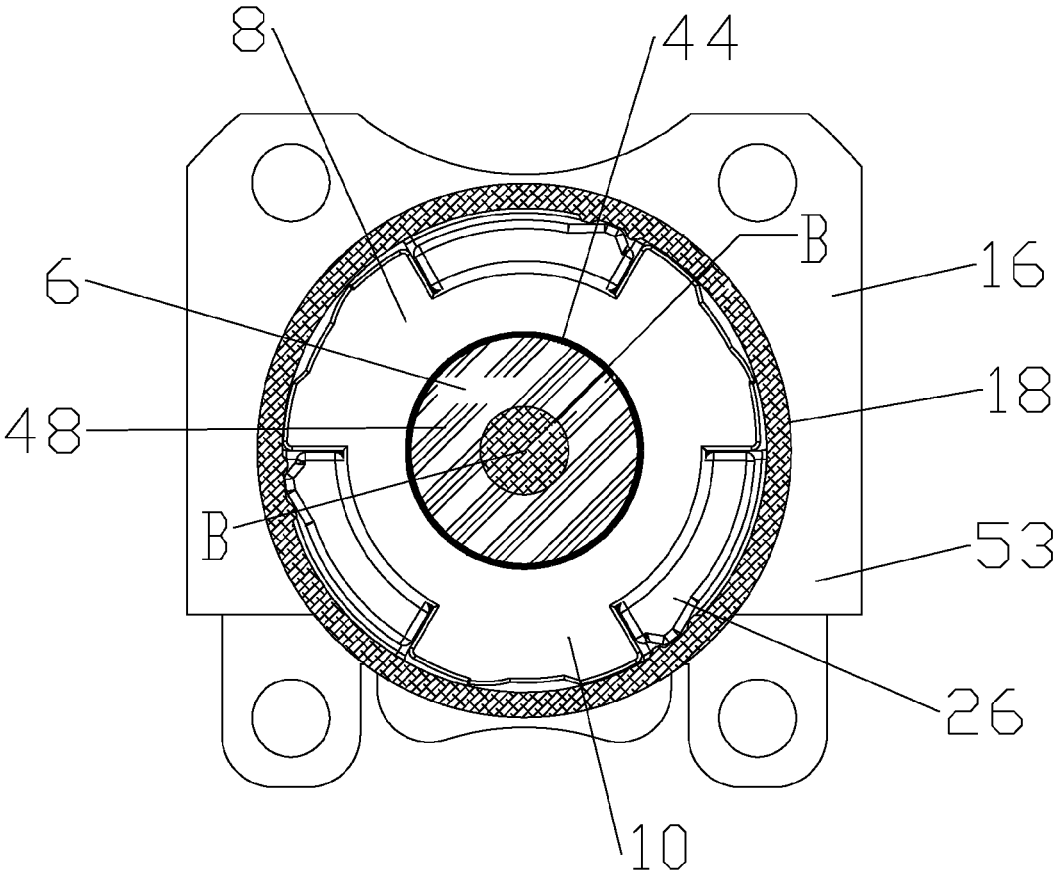
FIG. 15 is a cross-section end view of FIG. 13, along line B-B.
Figure 16:
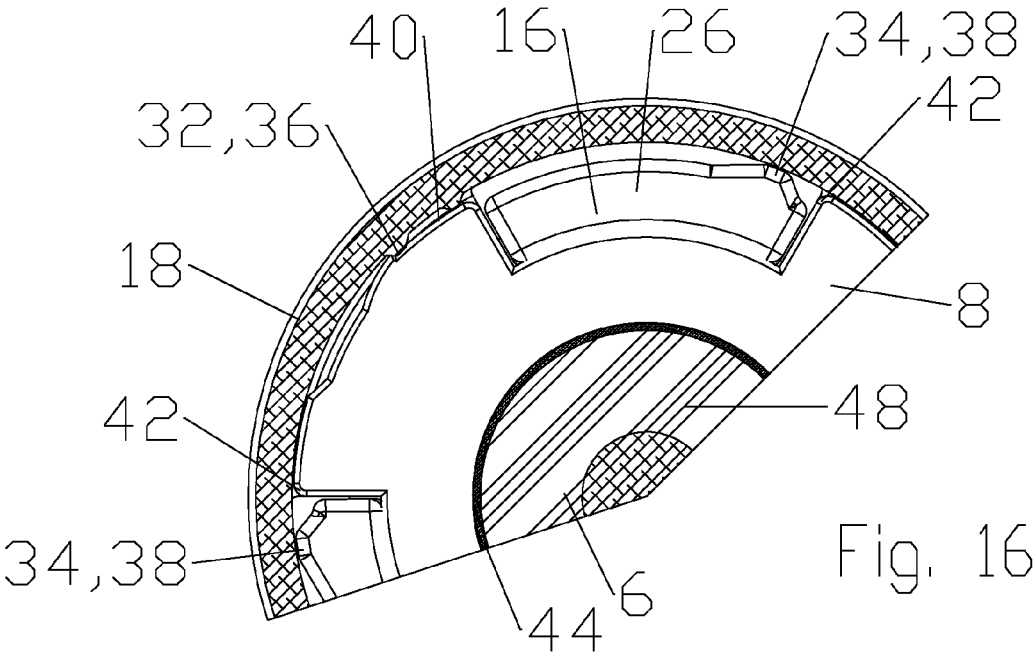
FIG. 16 is a close-up view of FIG. 15, cut along line B-B with the releasable retainer rotated sixty degrees to the initial insertion position.
Figure 17:
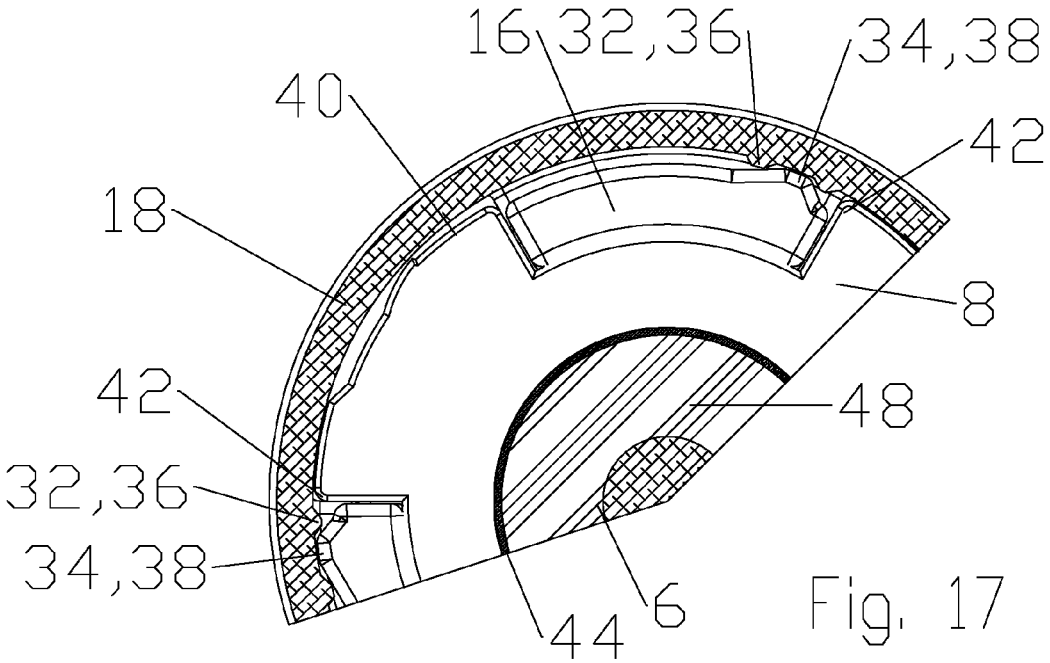
FIG. 17 is a view of FIG. 16, with the releasable retainer in the locked position.

The initial alignment of the releasable retainer 18 upon the male portion 8, for ease of male portion 8 insertion into and seating with the female portion 16, and/or rotatability characteristics of the releasable retainer 18 upon interconnection, may be controlled by interlock features of the releasable retainer 18 and the outer diameter surfaces of the base and/or connector tabs 26, 10, for example as shown in FIGS. 15-17.

A rotation lock of the releasable retainer 18, retaining the releasable retainer 18 in the engaged position, may be created by providing a tab seat lock 32 (see FIG. 5) on a sidewall of the tab seat 24 that meshes with a base tab lock 34 (see FIG. 10) provided on an outer diameter of the base tab 26, when the releasable retainer 18 is rotated into the engaged position. The tab seat lock 32 may be formed, for example, as a pair of radially inward protrusions 36 which the base tab lock 34, formed as a radial outward protrusion 38, seats between.

As best shown in FIG. 16, circumferential alignment of the releasable retainer 18 on the male portion 8 during initial insertion may be assisted by an outer diameter insertion surface 40 dimensioned to engage the tab seat lock 32 in an interference fit, retaining the releasable retainer 18 aligned in an in-line insertion position with respect to the connector tabs 10 so that the base tabs 26 can mesh with the connector tabs 10 as the outer sidewall 30 of the annular groove 28 is mated with the conical outer sidewall 30, without interference from the coupling tabs 22 retained in the shadow of the connector tabs 10. The interference fit between the tab seat lock 32 and the insertion surface 40 may be provided at a level of interference which retains the releasable retainer 18 in place as the male portion 8 is inserted through adjacent connectors and/or cables towards the female portion 16, but which allows rotation of the releasable retainer 18 to slide the tab seat lock 32 away from the insertion surface 40 upon application of torque to begin the rotation of the releasable retainer 18 with respect to the male and female portions 8, 16 as the releasable retainer 18 is rotated to the engaged position during final interconnection.

As the male and female portions 8, 16 may be visually obscured by the adjacent apparatus and/or cables during interconnection, a tactile feedback that the engagement position has been reached may be provided by a click action as the base tab lock 34 drops into engagement with the tab seat lock 32. Further feedback that the engagement position has been reached may be provided by dimensioning the connector tab 10 with an outer diameter stop surface 42 dimensioned to provide a positive stop with respect to rotation of the tab seat lock 32 past the base tab lock 34 (see FIG. 17). Thereby, the installer is unable to over-rotate the releasable retainer 18 past the engagement position.

The cable end 15 of the base tabs 26 and/or coupling tabs 22 may be provided with an angled engagement surface 52 (see FIG. 11) for ease of initial engagement therebetween. Thereby, as the releasable retainer 18 is rotated, the coupling tab 22 is driven against the angled engagement surface 52 and the coupling tab 22 is progressively drawn toward the cable end 15 as the coupling tab 22 advances along the engagement surface 52, driving the male portion 8 into engagement with the female portion 16.

One skilled in the art will appreciate that the connector tabs 10 mesh with the base tabs 26 as the outer diameter seat surface 12 is seated against the outer sidewall 30 (see FIG. 15), inhibiting rotation of the male portion 8 with respect to the female portion 16, allowing the releasable retainer 18 to be rotated without requiring an additional tool to inhibit rotation of the male portion 8, for example where the female portion 16 is configured for panel surface mounting via a mounting flange 53.

The stop shoulder 20 of the releasable retainer 18 may be formed with a retention lip 54 that projects radially inward (see FIG. 5). Thereby, the retention lip 54 may engage a corresponding radially outward protruding retention spur 56 of the male portion 8 (see FIG. 7), retaining the releasable retainer 18 upon the male portion 8 at the cable end 15. The retention spur 56 may be formed directly in the outer diameter of the male portion 8 or alternatively on an overbody 58 covering an outer diameter of the male portion 8 between the cable end 15 and the connector tabs 10. The overbody 58 may be sealed against a jacket of the cable 6 to provide both an environmental seal for the cable end of the interconnection and a structural reinforcement of the cable 6 to male portion 8 interconnection.

Returning to FIG. 14, a further environmental seal may be formed by applying an annular seal groove 60 in the outer diameter seat surface 12, in which a seal 62 such as an elastometric o-ring or the like may be seated. Because of the conical mating between the outer diameter seat surface 12 and the outer side wall 30, the seal 62 may experience reduced insertion friction compared to that encountered when seals are applied between telescoping cylindrical surfaces, enabling the seal 62 to be slightly over-sized, which may result in an improved environmental seal between the outer diameter seat surface 12 and the outer side wall 30.

The present embodiment demonstrates a coaxial cable outer conductor 44 to connector 4 interconnection in the male portion 8 which passes the outer conductor 44 through the male portion 8 into direct contact with the female portion 16, circumferentially clamped at the interconnection therebetween. Thereby, the several additional connector elements and/or internal connections common in conventional coaxial connectors with a cable to connector retention based upon interconnection with the outer conductor 44 may be eliminated. As best shown in FIG. 14, an inner sidewall 46 of the annular groove 28 is dimensioned to seat against a flared end of the outer conductor 44 of the coaxial cable 6 inserted through a bore 48 of the male portion 8, clamping the outer conductor 44 between the male and female portions 8, 16 when the outer diameter seat surface 12 is seated against the outer sidewall 30. One skilled in the art will appreciate that a direct pass through of the outer conductor 44 eliminates potential PIM sources present between each additional surface/contact point present in a conventional coaxial cable connector termination.

Alternatively, the seat surface 12 may be applied dimensioned to seat at the annular groove 28 as the primary contact of the interconnection, and the flared end of the outer conductor 44 coupled to the inner sidewall 46 as further described herebelow. Although an intimate contact may occur between the flared end of the outer conductor 44 and the outer sidewall 30, because the outer conductor 44 is already coupled (preferably molecular bond coupled) to the male portion 8, in this embodiment a high level "clamping force" is not required to secure the interconnection. Thereby, the strength requirements of the releasable retainer 18 and the interconnecting portions of the male and female portions 8, 16 it engages may be reduced.

The inventor has recognized that, in contrast to traditional mechanical, solder and/or conductive adhesive interconnections, a molecular bond type interconnection may reduce aluminum oxide surface coating issues, PIM generation and improves long term interconnection reliability.

A "molecular bond" as utilized herein is defined as an interconnection in which the bonding interface between two elements utilizes exchange, intermingling, fusion or the like of material from each of two elements bonded together. The exchange, intermingling, fusion or the like of material from each of two elements generates an interface layer where the comingled materials combine into a composite material comprising material from each of the two elements being bonded together.

One skilled in the art will recognize that a molecular bond may be generated by application of heat sufficient to melt the bonding surfaces of each of two elements to be bonded together, such that the interface layer becomes molten and the two melted surfaces exchange material with one another. Then, the two elements are retained stationary with respect to one another, until the molten interface layer cools enough to solidify.

The resulting interconnection is contiguous across the interface layer, eliminating interconnection quality and/or degradation issues such as material creep, oxidation, galvanic corrosion, moisture infiltration and/or interconnection surface shift.

A molecular bond between the outer conductor 44 of the cable 6 and the male portion 8 may be generated via application of heat to the desired interconnection surfaces between the outer conductor 44 and the male portion 8, for example via laser or friction welding. Friction welding may be applied, for example, as spin and/or ultrasonic type welding.

A molecular bond between the male portion 8 and outer conductor 44 may be formed by inserting the prepared end of the cable 6 into the bore 48 so that the outer conductor 44 is flush with the interface end 14 of the bore 48, enabling application of a laser to the circumferential joint between the outer diameter of the outer conductor 44 and the inner diameter of the bore 48 at the interface end 14.

Alternatively, a molecular bond may be formed via ultrasonic welding by applying ultrasonic vibrations under pressure in a join zone between two parts desired to be welded together, resulting in local heat sufficient to plasticize adjacent surfaces that are then held in contact with one another until the interflowed surfaces cool, completing the molecular bond. An ultrasonic weld may be applied with high precision via a sonotrode and/or simultaneous sonotrode ends to a point and/or extended surface. Where a point ultrasonic weld is applied, successive overlapping point welds may be applied to generate a continuous ultrasonic weld. Ultrasonic vibrations may be applied, for example, in a linear direction and/or reciprocating along an arc segment, known as torsional vibration.

An outer conductor molecular bond with the male portion 8 via ultrasonic welding is demonstrated in FIG. 9. A flare surface 50 angled radially outward from the bore 6 toward the interface end 14 of the male portion 8 is open to the interface end 14 of the male portion 8, providing a mating surface to which a leading end flare of the outer conductor 44 may be ultrasonically welded by an outer conductor sonotrode of an ultrasonic welder inserted to contact the leading end flare from the interface end 14.

In alternative embodiments the interconnection between the cable 6 and the male and/or female portions 8, 16 may be applied more conventionally, for example utilizing clamp-type and/or soldered interconnections well known in the art.

Prior to interconnection, the leading end of the cable 6 may be prepared by cutting the cable 6 so that inner conductor(s) 63 extend from the outer conductor 44. Also, a dielectric material that may be present between the inner conductor(s) 63 and outer conductor 44 may be stripped back and a length of the outer jacket removed to expose desired lengths of each. The inner conductor 63 may be dimensioned to extend through the attached coaxial connector for direct interconnection with the female portion 16 as a male inner conductor coupling surface 65 part of the connection interface. Alternatively, for example where the connection interface selected requires an inner conductor profile that is not compatible with the inner conductor 63 of the selected cable 6 and/or where the material of the inner conductor 63 is an undesired inner conductor connector interface material, such as aluminum, the inner conductor 63 may be terminated by applying an inner conductor cap 64 operative as the male inner conductor coupling surface 65.

The inner conductor cap 64, for example formed from a metal such as brass, bronze or other desired metal, may be applied with a molecular bond to the end of the inner conductor 63, also by friction welding such as spin or ultrasonic welding. The inner conductor cap 64 may be provided with an inner conductor socket at the cable end 15 and a desired inner conductor interface at the interface end 14. The inner conductor socket may be dimensioned to mate with a prepared end of an inner conductor of the cable 6. To apply the inner conductor cap 64, the end of the inner conductor 63 may be prepared to provide a pin profile corresponding to the selected socket geometry of the inner conductor cap 64. To allow material inter-flow during welding attachment, the socket geometry of the inner conductor cap 64 and/or the end of the inner conductor 63 may be formed to provide a material gap when the inner conductor cap 64 is seated upon the prepared end of the inner conductor 63.

A rotation key may be provided upon the inner conductor cap 64, the rotation key dimensioned to mate with a spin tool or a sonotrode for rotating and/or torsionally reciprocating the inner conductor cap 64, for molecular bond interconnection via spin or ultrasonic friction welding.

Alternatively, the inner conductor cap 64 may be applied via laser welding applied to a seam between the outer diameter of the inner conductor 63 and an outer diameter of the cable end 15 of the inner conductor cap 64.

To further eliminate PIM generation also with respect to the connection interface between the coaxial connectors, the outer conductor 44 may be coupled to the male portion 8 (preferably by molecular bond interconnection) and the connection interface modified to apply capacitive coupling, instead of conventional "physical contact" galvanic electromechanical coupling.

Capacitive coupling may be obtained by applying a dielectric spacer between the inner and/or outer conductor contacting surfaces of the connector interface. Capacitive coupling between spaced apart conductor surfaces eliminates the direct electrical current interconnection between these surfaces that is otherwise subject to PIM generation/degradation as described herein above with respect to cable conductor to connector interconnections.

One skilled in the art will appreciate that a capacitive coupling interconnection may be optimized for a specific operating frequency band. For example, the level of capacitive coupling between separated conductor surfaces is a function of the desired frequency band(s) of the electrical signal (s), the surface area of the separated conductor surfaces, the dielectric constant of a dielectric spacer and the thickness of the dielectric spacer (distance between the separated conductor surfaces).

Figure 18:
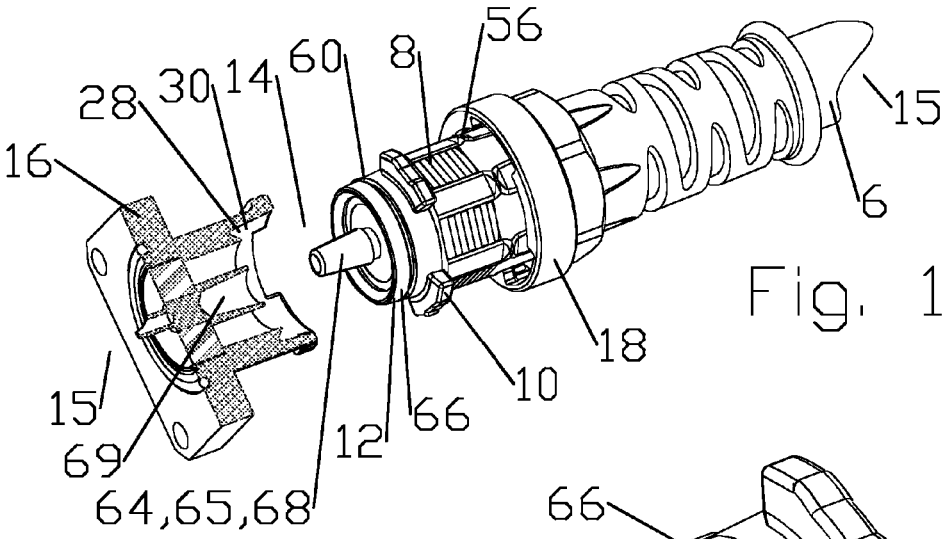
FIG. 18 is a schematic isometric partial cut-away view of an exemplary embodiment of a connector with a capacitive coupling connector interface.
Figure 19:
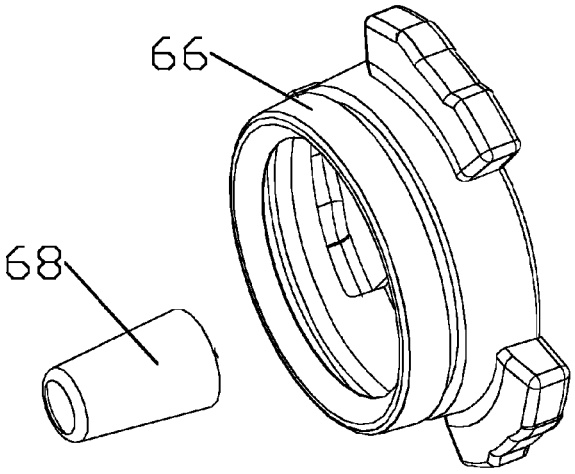
FIG. 19 is a schematic isometric view of inner and outer conductor dielectric spacers of the connector of FIG. 18.
Figure 20:
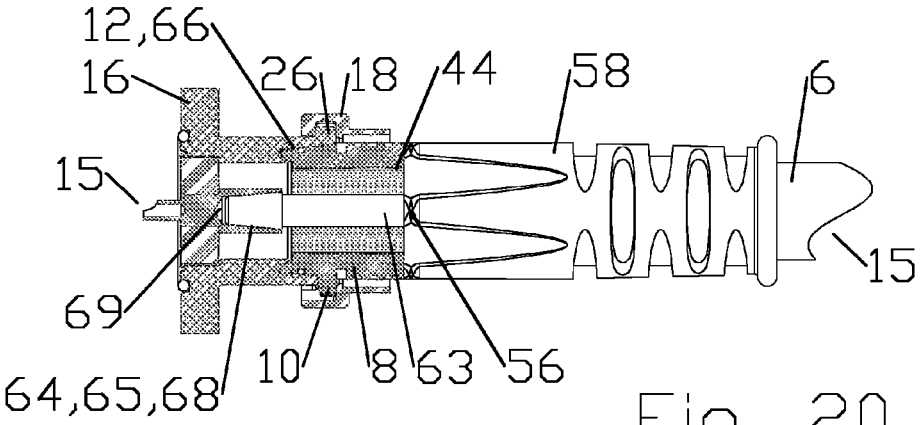
FIG. 20 is a schematic partial cut-away side view of the connector of FIG. 18.

The dielectric spacer may be applied, for example as shown in FIGS. 18-20. with respect to the outer conductor 44 as an outer conductor dielectric spacer 66 by providing at least the connector end of the male portion (the seating surface 12) with a dielectric coating, demonstrated schematically in FIG. 19. Where a tabbed connector interface is applied, the outer conductor dielectric spacer 66 may be applied covering the base tabs 26. Similarly, the inner conductor cap 64 may be covered at the interface end 14 and/or outer diameter with a dielectric coating to form an inner conductor dielectric spacer 68. Thereby, when the male portion 8 is secured within a corresponding female portion 16, an entirely capacitively coupled interconnection interface is formed. That is, there is no direct galvanic interconnection between the inner conductor or outer conductor electrical pathways across the connection interface.

The dielectric coatings of the outer and inner conductor dielectric spacers 66, 68 may be provided, for example, as a ceramic or polymer dielectric material. One example of a dielectric coating with suitable compression and thermal resistance characteristics that may be applied with high precision at very thin thicknesses is ceramic coatings. Ceramic coatings may be applied directly to the desired surfaces via a range of deposition processes, such as Physical Vapor Deposition (PVD) or the like. Ceramic coatings have a further benefit of a high hardness characteristic, thereby protecting the coated surfaces from damage prior to interconnection and/or resisting thickness variation due to compressive forces present upon interconnection. The ability to apply extremely thin dielectric coatings, for example as thin as 0.5 microns, may reduce the surface area requirement of the separated conductor surfaces, enabling the overall dimensions of the connection interface to be reduced.

Figure 21:
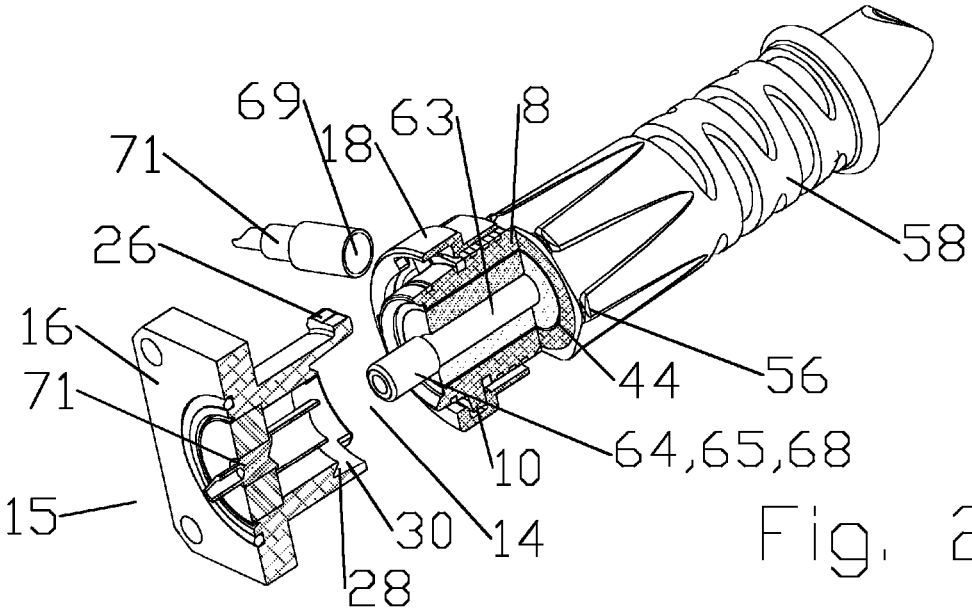
FIG. 21 is a schematic isometric partial cut-away view of another exemplary embodiment of a connector with a capacitive coupling interface, including a schematic isometric rotated view of the inner contact.
Figure 22:
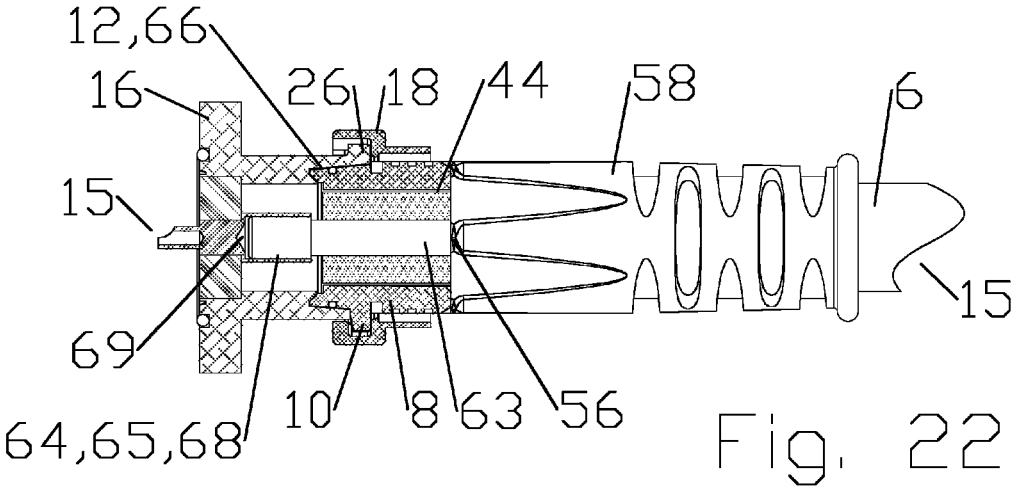
FIG. 22 is a schematic partial cut-away side view of the connector of FIG. 21.
Figure 23:
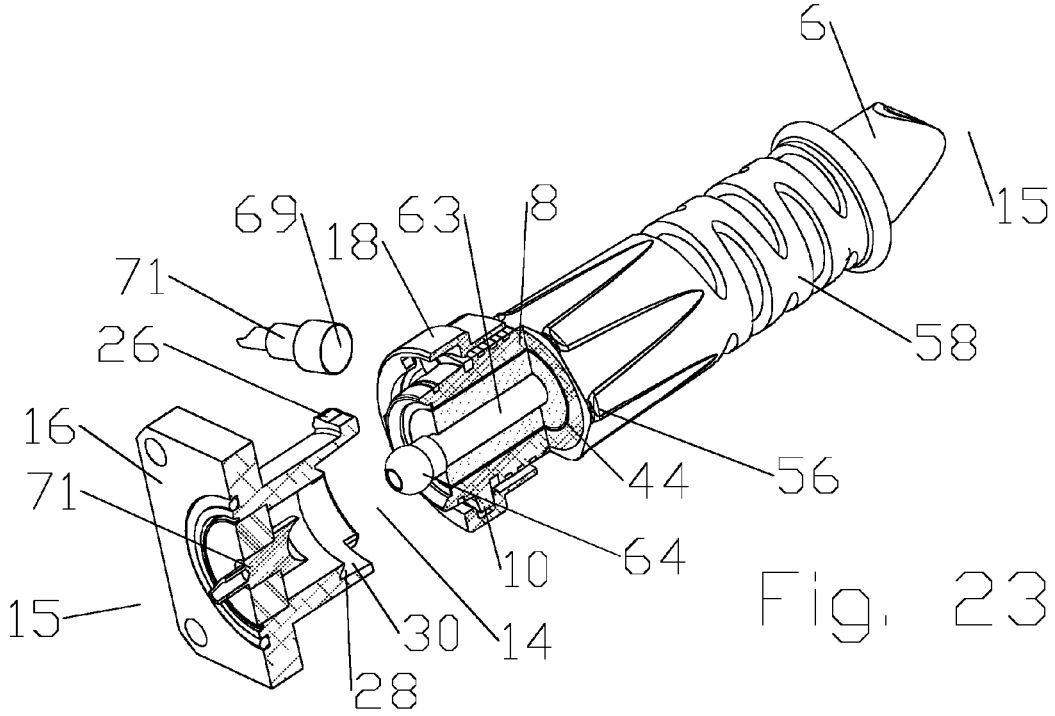
FIG. 23 is a schematic isometric partial cut-away view of another exemplary embodiment of a connector with a capacitive coupling interface, including a schematic isometric rotated view of the inner contact.
Figure 24:
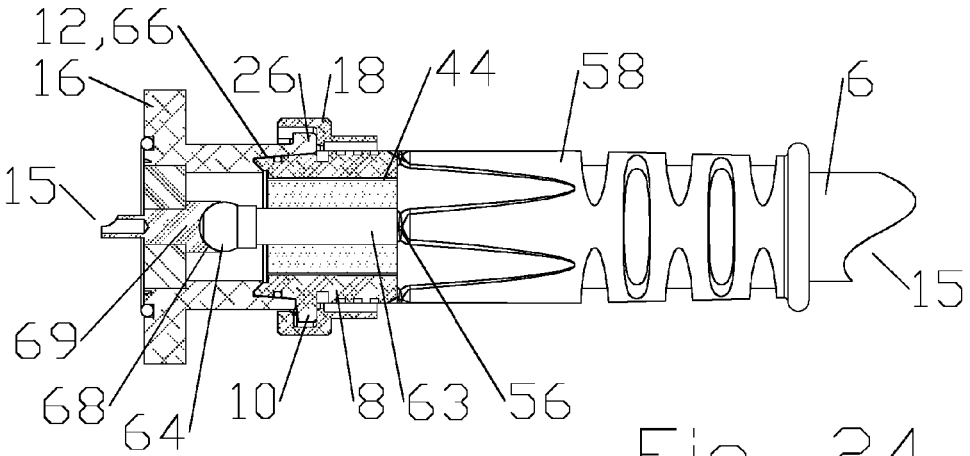
FIG. 24 is a schematic partial cut-away side view of the connector of FIG. 23.
Figure 25:
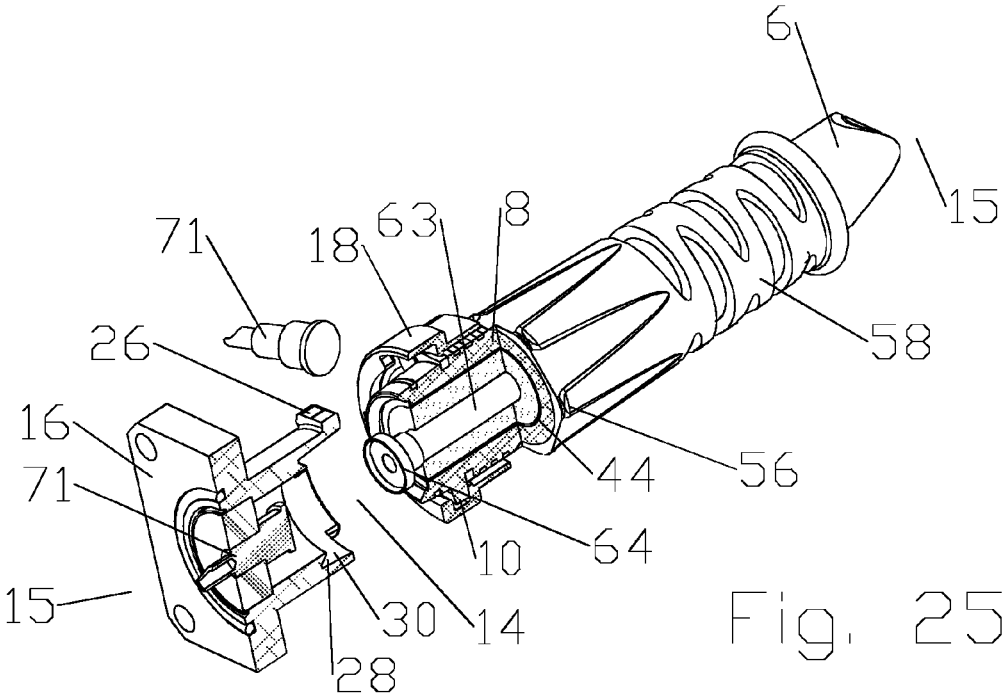
FIG. 25 is a schematic isometric partial cut-away view of another exemplary embodiment of a connector with a capacitive coupling interface, including a schematic isometric rotated view of the inner contact.
Figure 26:
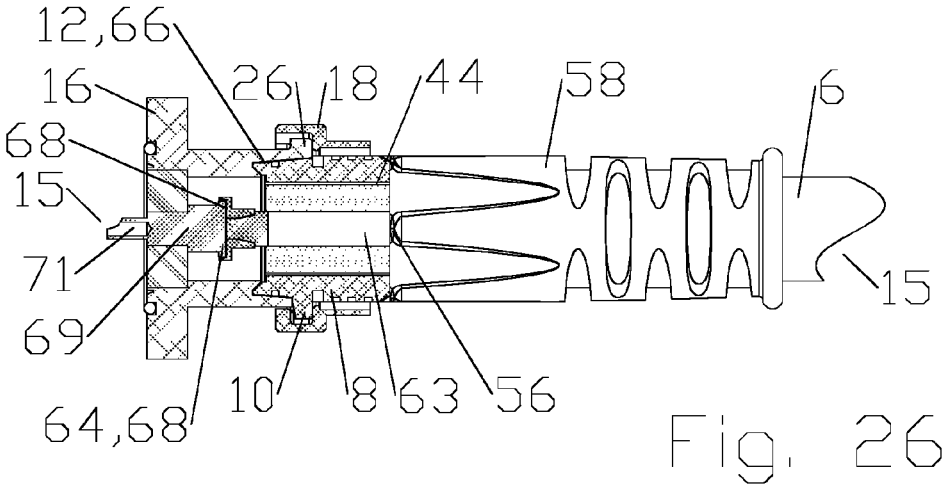
FIG. 26 is a schematic partial cut-away side view of the connector of FIG. 25.
Figure 27:
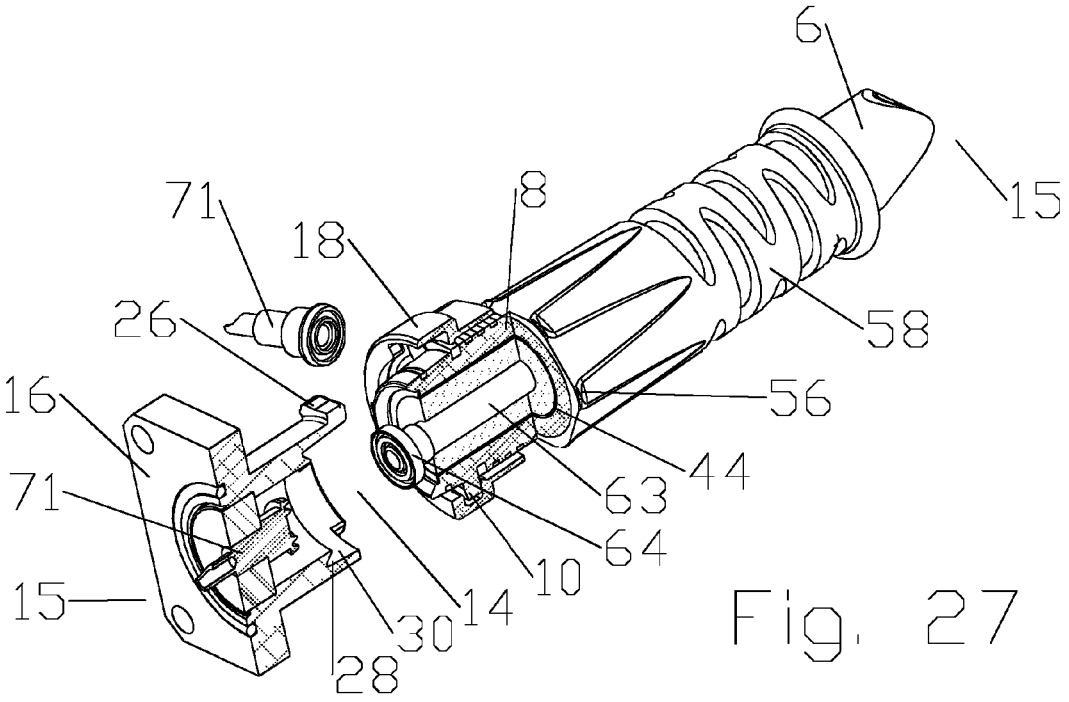
FIG. 27 is a schematic isometric partial cut-away view of another exemplary embodiment of a connector with a capacitive coupling interface, including a schematic isometric rotated view of the inner contact.
Figure 28:
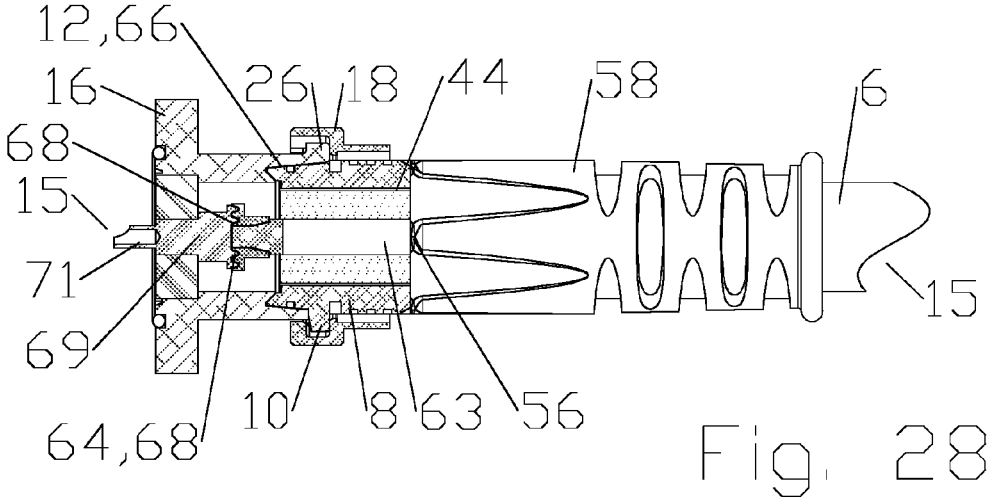
FIG. 28 is a schematic partial cut-away side view of the connector of FIG. 27.
Figure 29:
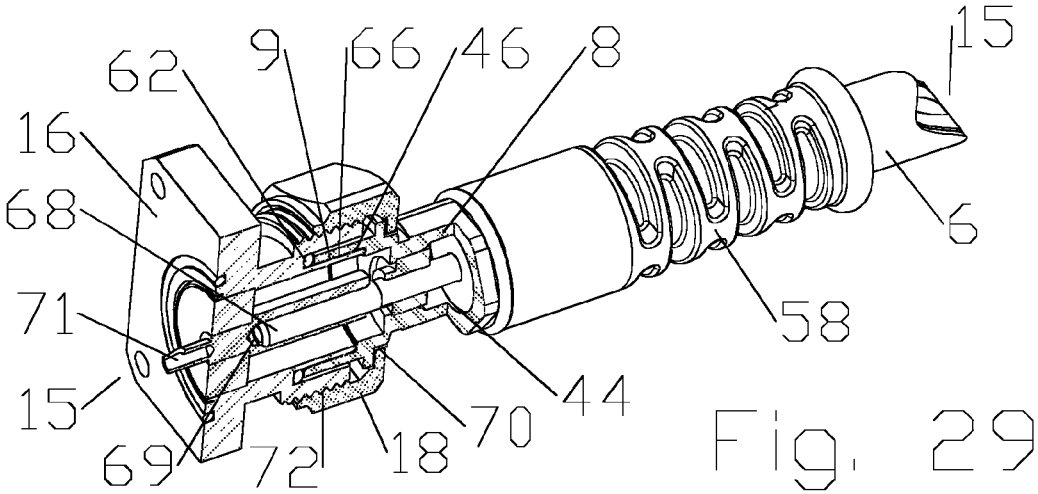
FIG. 29 is a schematic isometric partial cut-away view of an exemplary embodiment of a connector with a capacitive coupling connector interface.
Figure 30:
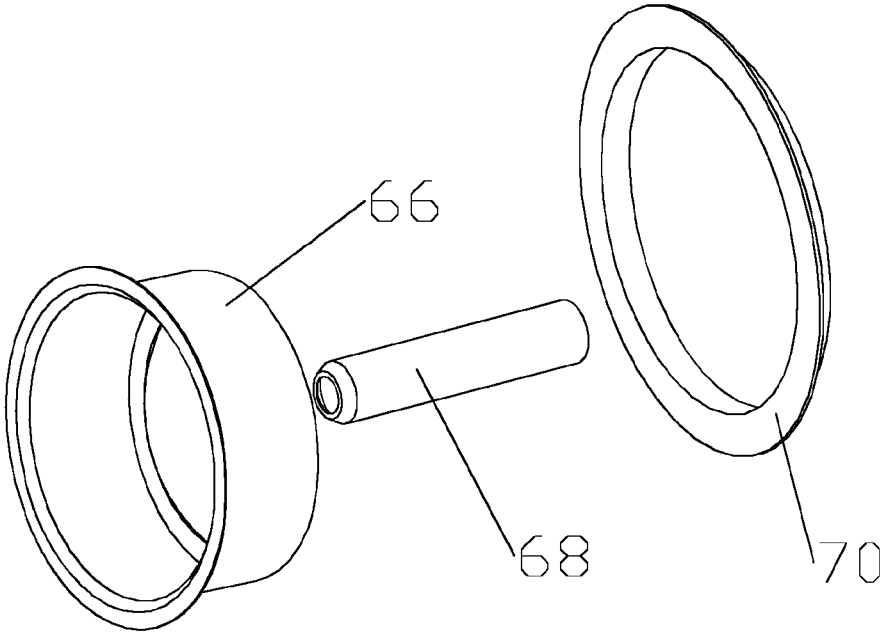
FIG. 30 is a schematic isometric view of inner conductor, outer conductor and retainer dielectric spacers of the connector of FIG. 29.
Figure 31:
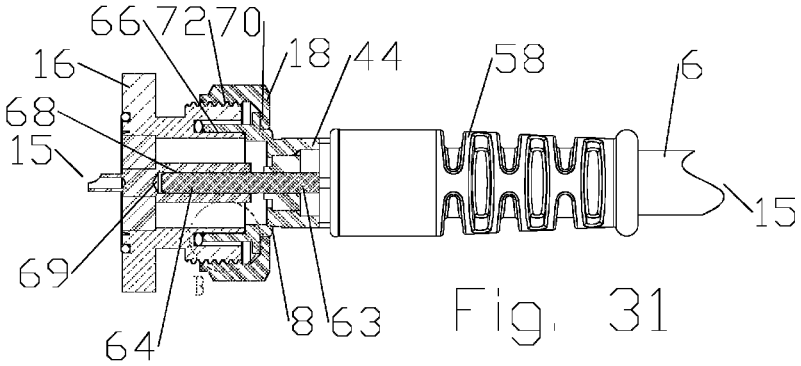
FIG. 31 is a schematic partial cut-away side view of the connector of FIG. 29.
Figure 32:
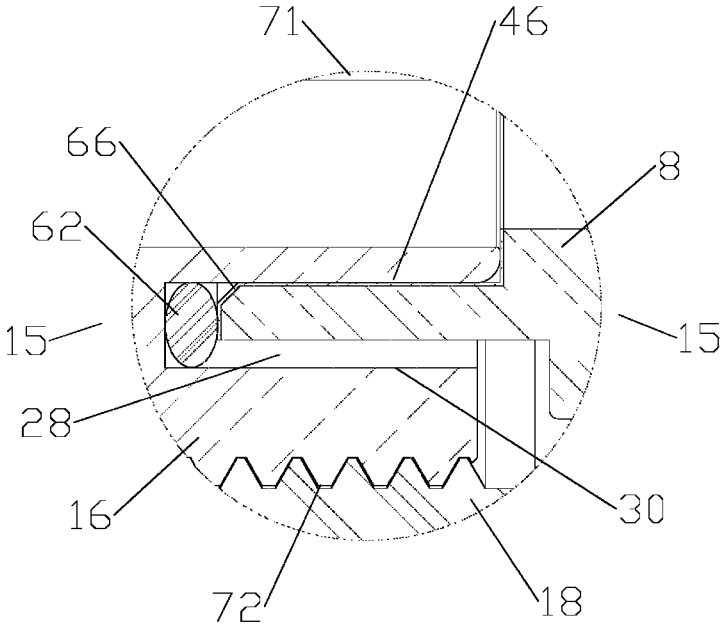
FIG. 32 is a close-up view of area B of FIG. 31.

The inner conductor dielectric spacer 68 covering the inner conductor cap 64 is demonstrated as a conical surface in FIGS. 18-20. The conical surface, for example applied at a cone angle corresponding to the cone angle of the male outer conductor coupling surface (conical seat surface 12), may provide an increased range of initial insertion angles for ease of initiating the interconnection and protection of these inner and outer conductor dielectric spacers 68,66 during initial mating for interconnection. Alternatively, the inner conductor cap 64 and corresponding female inner conductor coupling surfaces 69 of the inner conductor contact 71 may be formed, for example, in a configuration that is cylindrical (FIGS. 21 and 22), spherical (FIGS. 23 and 24), planar normal to the longitudinal axis (FIGS. 25 and 26) or corrugated normal to the longitudinal axis (FIGS. 27 and 28) to satisfy specific surface area, thickness and/or dielectric strength requirements.

Further, capacitive coupling may be applied to connection interfaces with conventional releasable retainer 18 configurations. For example as shown in FIGS. 29-32, a variation of a standard DIN connector interface applies telescopic mating between the seating surface 12 and the annular groove 28, wherein the outer conductor dielectric spacer 66 is applied between a male outer seating surface 9 provided on an inner diameter of the interface end 14 of the male portion 8 and the inner sidewall 46 of the annular groove 28 of the female portion 16.

The releasable retainer 18 has been demonstrated formed from a dielectric material, for example a fiber reinforced polymer. Therefore, the releasable retainer 18 does not create a galvanic electro-mechanical coupling between the male portion 8 and the female portion 16. Where the additional wear and/or strength characteristics of a metal material releasable retainer 18 are desired, for example where the releasable retainer 18 is a conventional threaded lock ring that couples with threads 72 of the female portion 16 to draw the male and female portions 8, 16 together and secure them in the interconnected position, a retainer dielectric spacer 70 may be applied, between seating surfaces of the releasable retainer 18 and the male portion 8, to electrically isolate the releasable retainer 18 from the male portion 8, for example as shown in FIGS. 29-32.

The exemplary embodiments are demonstrated with respect to a cable 6 that is an RF-type coaxial cable. One skilled in the art will appreciate that the connection interface may be similarly applied to any desired cable 6, for example multiple conductor cables, power cables and/or optical cables, by applying suitable conductor mating surfaces/individual conductor interconnections aligned within the bore 48 of the male and female portions 8, 16.

Exemplary embodiments have been herein demonstrated with three connector tabs 10, coupling tabs 22 and base tabs 26. A three tab configuration provides a sixty degree rotation engagement characteristic. That is, the interconnection may be fully engaged by rotating the releasable retainer 18 sixty degrees with respect to the female portion 16. Further, the symmetrical distribution of the tabs provides symmetrical support to the interconnection along the longitudinal axis.

One skilled in the art will appreciate that the number of tabs may be increased, resulting in a proportional decrease in the angular rotation engagement characteristic. As the number of tabs is increased a tradeoff may apply in that the area available on the base tabs 26 for an engagement surface 52 decreases, which may require a steeper engagement surface angle to be applied and/or otherwise complicate initial engagement characteristics. Further, as the dimensions of the individual tabs decrease, materials with increased strength characteristics may be required.

One skilled in the art will further appreciate that the tabbed connector interface provides a quick connect rigid interconnection with a reduced number of discrete elements, which may simplify manufacturing and/or assembly requirements. Contrary to conventional connection interfaces featuring threads, the conical aspect of the seat surface 12 is generally self-aligning, allowing interconnection to be initiated without precise initial male to female portion 8, 16 alignment along the longitudinal axis.

The application of capacitive coupling to male and female portions 8, 16 which are themselves provided with molecular bond interconnections with continuing conductors, enables a quick connectable RF circuit that may be entirely without PIM.

Table of Parts

| | |
|---|---|
| 2 | wrench |
| 4 | connector |
| 6 | cable |
| 8 | male portion |
| 9 | male outer conductor coupling surface |
| 10 | connector tab |
| 12 | seat surface |
| 14 | interface end |
| 15 | cable end |
| 16 | female portion |
| 18 | releasable retainer |
| 20 | stop shoulder |
| 22 | coupling tab |
| 24 | tab seat |
| 26 | base tab |
| 28 | annular groove |
| 30 | outer sidewall |
| 32 | tab seat lock |
| 34 | base tab lock |
| 36 | inward protrusion |
| 38 | outward protrusion |
| 40 | insertion surface |
| 42 | stop surface |
| 44 | outer conductor |
| 46 | inner sidewall |
| 48 | bore |
| 50 | flare surface |
| 52 | engagement surface |
| 53 | mounting flange |
| 54 | retention lip |
| 56 | retention spur |
| 58 | overbody |
| 60 | seal groove |
| 62 | seal |
| 63 | inner conductor |
| 64 | inner conductor cap |
| 65 | male inner conductor coupling surface |
| 66 | outer conductor dielectric spacer |
| 68 | inner conductor dielectric spacer |
| 69 | female inner conductor coupling surface |
| 70 | retainer dielectric spacer |
| 71 | inner conductor contact |
| 72 | threads |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A connector with a capacitively coupled connector interface for interconnection with a female portion provided with an annular groove, with a sidewall, open to an interface end of the female portion, comprising:

a male portion provided with a male outer conductor coupling surface at an interface end;

the male outer conductor coupling surface covered by an outer conductor dielectric spacer;

the male outer conductor coupling surface dimensioned to seat, spaced apart from the sidewall by the outer conductor dielectric spacer, within the annular groove, when the male portion and the female portion are in an interlocked position; and a releasable retainer dimensioned to secure the male portion and the female portion in the interlocked position.

2. The connector of claim 1, further including an annular groove provided in the male outer conductor coupling surface, in which a seal is seated.

3. The connector of claim 1, wherein the male portion is coupled to an outer conductor of a cable by a molecular bond between the outer conductor and the male portion.

4. The connector of claim 1, wherein the releasable retainer is electrically isolated from the male portion by a retainer dielectric spacer.

5. The connector of claim 1, wherein the releasable retainer and the female portion are provided with threads.

6. The connector of claim 1, wherein the releasable retainer is a dielectric material.

7. The connector of claim 1, further including a male inner conductor coupling surface at the interface end of the male connector;

an inner conductor dielectric spacer covering the male inner conductor coupling surface;

the male inner conductor coupling surface spaced apart from a female inner conductor coupling surface at the interface end of the female portion, coaxial with the annular groove, by the inner conductor dielectric spacer, when the male portion and the female portion are in the interlocked position.

8. The connector of claim 7, wherein the male inner conductor coupling surface is conical.

9. The connector of claim 7, wherein the male inner conductor coupling surface is cylindrical.

10. The connector of claim 1, wherein the male portion is provided with at least three outer diameter radially projecting connector tabs; the male outer conductor coupling surface provided with a conical outer diameter seat surface at the interface end;

the releasable retainer provided with a stop shoulder and at least three radially inward coupling tabs at the interface end; the releasable retainer dimensioned to seat around the male portion, the stop shoulder abutting a cable end of the connector tabs; a tab seat provided between the coupling tabs and the stop shoulder;

the female portion provided with at least three outer diameter radial projecting base tabs; the conical outer diameter seat surface dimensioned to mate with the sidewall;

the base tabs dimensioned to engage the coupling tabs when the base tabs are inserted into the tab seat, retaining the outer diameter seat surface against the sidewall, spaced apart by the dielectric spacer.

11. The connector of claim 10, further including a tab seat lock on a sidewall of the tab seat and a base tab lock on an outer diameter of the base tab; the tab seat lock and the base tab lock dimensioned to mesh with one another when the base tabs are inserted into the tab seat, inhibiting rotation of the releaseable retainer.

12. The connector of claim 10, wherein the connector tab is provided with an outer diameter insertion surface dimensioned to engage the tab seat lock in an interference fit, retaining the releasable retainer aligned in an insertion position with respect to the connector tabs.

13. The connector of claim 10, wherein the base tab is provided with an outer diameter stop surface dimensioned to provide a positive stop with respect to rotation of the tab seat lock past the base tab lock.

14. The connector of claim 10, wherein a cable end of the base tab is provided with an angled engagement surface; the engagement surface progressively drawing the coupling tab and thereby the male portion towards the female portion as the releasable retainer is rotated.

15. The connector of claim 10, wherein the connector tabs mesh with the base tabs as the outer diameter seat surface is seated against the outer sidewall, inhibiting rotation of the male portion with respect to the female portion.

16. The connector of claim 10, wherein the stop shoulder has a radially inward projecting retention lip; the retention lip engaging a radial outward protruding retention spur of the male portion, retaining the releasable retainer upon the male portion.

17. The connector of claim 10, wherein the outer conductor dielectric spacer covers the base tabs.

18. A method for manufacturing a connector according to claim 1, comprising the steps of:

forming the outer conductor dielectric spacer as a layer of ceramic material upon the outer conductor coupling surface.

19. The method of claim 18, wherein the ceramic material is applied by physical vapor deposition upon the seating surface.

20. A method for manufacturing a connector according to claim 7, comprising the steps of:

forming the inner conductor dielectric spacer as a layer of ceramic material upon the male inner conductor surface.

* * * * *